US012116799B1

(12) United States Patent
Shen

(10) Patent No.: US 12,116,799 B1
(45) Date of Patent: Oct. 15, 2024

(54) MULTI-FUNCTIONAL FENCE SYSTEM

(71) Applicant: Long Xiang Shen, San Bernardino, CA (US)

(72) Inventor: Long Xiang Shen, San Bernardino, CA (US)

( * ) Notice: Subject to any disclaimer, the term of this patent is extended or adjusted under 35 U.S.C. 154(b) by 0 days.

(21) Appl. No.: 18/540,765

(22) Filed: Dec. 14, 2023

(51) Int. Cl.
*E04H 17/14* (2006.01)
*E04H 17/22* (2006.01)

(52) U.S. Cl.
CPC ..... *E04H 17/1465* (2021.01); *E04H 17/22* (2013.01)

(58) Field of Classification Search
CPC ..... E04H 17/00; E04H 17/009; E04H 17/14; E04H 17/1413; E04H 17/1447; E04H 17/1448; E04H 17/1473; E04H 17/1488; E04H 17/16; E04H 17/17; E04H 17/18; E04H 17/185; E04H 17/22; E04H 17/23
See application file for complete search history.

(56) References Cited

U.S. PATENT DOCUMENTS 1,221,481 A * 4/1917 Selway ..... E04H 17/23 52/150
1,249,848 A * 12/1917 Sprague ..... F16B 7/048 52/150
2,581,318 A * 1/1952 Bartlett ..... E04H 17/18 256/25
3,092,407 A * 6/1963 Blonder ..... F16B 2/08 256/65.05
5,593,143 A * 1/1997 Ferrarin ..... E04H 17/08 248/74.1
9,151,074 B2 * 10/2015 Walters ..... E04H 17/1448
9,174,107 B2 * 11/2015 Dettor ..... E04H 17/127
D748,818 S * 2/2016 Shen ..... D25/48.8
9,637,931 B2 * 5/2017 Hart ..... E04H 17/1448
10,214,935 B2 * 2/2019 Whiteley ..... E04H 12/2238
10,221,586 B2 * 3/2019 Mayer, Jr. ..... E04H 17/1488
D880,726 S * 4/2020 Shen ..... D25/48.8
11,225,810 B2 * 1/2022 Bacon ..... E04H 17/009
11,330,916 B1 * 5/2022 Zhang ..... E04H 17/18
11,371,258 B2 * 6/2022 Goodin ..... E04H 17/009
11,802,420 B2 * 10/2023 Rosicki ..... E04H 17/1439
2005/0285091 A1 * 12/2005 Ko ..... E04H 17/1488 256/24
2010/0193756 A1 8/2010 Buckley
2014/0131647 A1 * 5/2014 Dillon ..... E04H 17/1488 256/21

FOREIGN PATENT DOCUMENTS

DE 102006009367 A1 * 9/2007 ..... E04H 17/1421
EP 2716841 A1 * 4/2014 ..... E04H 17/1421
GB 2378473 A * 2/2003 ..... E04H 17/1443
GB 2518968 A * 4/2015 ..... E01F 13/022
KR 20090063386 A * 6/2009

* cited by examiner

*Primary Examiner* — Jonathan P Masinick
(74) *Attorney, Agent, or Firm* — Ying-Ting Chen; Law Office of Michael Chen

(57) ABSTRACT

A multi-functional fence system includes a plurality of vertical supporting frames; a plurality of horizontal supporting frames; and a plurality of connector assemblies configured to connect the vertical supporting frames and the horizontal supporting frames; wherein the vertical supporting frame is rotated with respect to the horizontal supporting frame via the connector assembly.

19 Claims, 9 Drawing Sheets

MULTI-FUNCTIONAL FENCE SYSTEM

FIELD OF THE DISCLOSURE

The present disclosure relates to the fence system and, more particularly, to a multi-functional fence system suitable for selectively extending the overall length of the fence system and allowing the fence system to be angled at a predetermined range of degrees. It is particularly suitable for using the fence system on different ground levels.

BACKGROUND OF THE DISCLOSURE

Generally, fences are well known for providing security to property. Typically, a fence includes a series of posts set in-ground, cement, a concrete slab, or the like, with fencing infill material spanning between or across the posts. Fabric fences are commonly used as pool fencing. Common fabrics are textiles woven from polypropylene or polyethylene yarn, opaque, waterproof, and wind-resistant.

Fabric fencing panels are lined on all sides and have grommets for attaching to wood or metal fence posts and railings. There are several advantages to the fabric facing. First, fence installation is easy and friendly, so the fabric fence is one of the most economical privacy fencing options. Next, the fabric fencing is removable. When the fabric fencing is not used, the user could remove and store the fence. Moreover, the user can reinstall it without any inconvenience. Last, compared to other fencing materials such as wrought iron, vinyl, and glass, a fabric fence is reasonably priced, making it a cost-effective choice for pool fencing material.

However, fabric fencing panels have several drawbacks. First, normally, fabric fencing needs to be more durable and reliable. For example, conventional fabric fencing can only be used on a flat surface; once the fencing is placed on a different level of ground, it is unstable and cannot be securely supported. Further, the fencing may comprise several panel frames coupled with each other, and each panel frame may not be angled.

There is a desire to develop a multi-functional fence system that is easy to assemble and install on different kinds and levels of ground.

All referenced patents, applications and literature are incorporated herein by reference in their entirety. Furthermore, where a definition or use of a term in a reference, which is incorporated by reference herein, is inconsistent or contrary to the definition of that term provided herein, the definition of that term provided herein applies and the definition of that term in the reference does not apply. The disclosed embodiments may seek to satisfy one or more of the above-mentioned desires. Although the present embodiments may obviate one or more of the above-mentioned desires, it should be understood that some aspects of the embodiments might not necessarily obviate them.

BRIEF SUMMARY OF THE DISCLOSURE

In a general implementation, a multi-functional fence system may further comprise a plurality of vertical supporting frames; a plurality of horizontal supporting frames; a plurality of connector assemblies configured to connect the vertical supporting frames and the horizontal supporting frames; wherein the vertical supporting frame is rotated with respect to the horizontal supporting frame via the connector assembly.

In another aspect combinable with the general implementation, the vertical supporting frame is vertically arranged to the horizontal supporting frame.

Among the many possible implementations of the multi-functional fence system may further comprise an elongated base supporting unit where a bottom portion of the vertical supporting frame is passed therethrough, and the bottom portion of the vertical supporting frame is inserted into a ground.

Further, it is contemplated that the vertical supporting frame comprises a top portion coupled with a middle portion of the vertical supporting frame, and a bottom portion of the vertical supporting frame is coupled with the middle portion of the vertical supporting frame.

In the alternative, the connector assembly comprises a first connector and a second connector, wherein one of the vertical supporting frames is coupled with the first connector and the second connector.

It is still further contemplated that the connector assemblies comprise a first pair of the first connectors and a first pair of the second connectors, wherein the first pair of the first connectors and the first pair of the second connectors are coupled with one of the vertical supporting frames.

In one embodiment, the first connector is rotated with respect to the second connector along the same one of the vertical supporting frames from sixty degrees to one hundred degrees.

Another aspect of the embodiment is directed to the connector assembly which comprises a first connector coupled with one of the horizontal supporting frames and a second connector coupled with the other one of the horizontal supporting frames, wherein one of the vertical supporting frames is angled with respect to the other one of the horizontal supporting frames from sixty degrees to one hundred degrees.

In another aspect combinable with the general implementation, the connector assembly comprises a first connector having a first main through hole vertically passed through the first connector, and a first side through hole horizontally passed through the first connector.

In another aspect combinable with the general implementation, the vertical support frame is passed through the first main through hole and the horizontal supporting frame is passed through the first side through hole.

In another aspect combinable with the general implementation, the second connector has a second main through hole vertically passed through the second connector, and a second side through hole horizontally passed through the second connector.

In another aspect combinable with the general implementation, the connector assembly comprises a first connector having a first main through hole and a second connector having a second main through hole, wherein one of the horizontal supporting frames is passed through the first main through hole and the second main through hole.

In another aspect combinable with the general implementation, the connector assembly comprises a first connector having a first main through hole and a second connector having a second main through hole, wherein one of the vertical supporting frames is passed through the first main through hole and the second main through hole.

In another aspect combinable with the general implementation, the connector assembly comprises a first connector having a first side through hole and a second connector having a second side through hole, wherein one of the horizontal supporting frames is passed through the first side through hole and the other one of the horizontal supporting frames is passed through the second side through hole.

In another aspect combinable with the general implementation, one of the horizontal supporting frames is secured at the same height as the other one of the horizontal supporting frames along the vertical supporting frame.

In another aspect combinable with the general implementation, the connector assembly comprises a first connector having a top face and a side face integrally extended from the top face and a second connector having a concave inner face and a convex outer face.

In another aspect combinable with the general implementation, the concave inner face is faced towards the top face and the side face of the first connector and the convex outer face is formed on an opposite side of the concave inner face.

In another aspect combinable with the general implementation, the connector assembly comprises a first connector and a second connector overlappedly arranged with the first connector.

In another aspect combinable with the general implementation, the multi-functional fence system may further comprise a cover having a plurality locking through holes cooperated with a plurality of cable to secure the cover on the vertical supporting frames and the horizontal supporting frames.

While this specification contains many specific implementation details, these should not be construed as limitations on the scope of any inventions or of what may be claimed, but rather as descriptions of features specific to particular implementations of particular inventions. Certain features that are described in this specification in the context of separate implementations can also be implemented in combination in a single implementation. Conversely, various features that are described in the context of a single implementation can also be implemented in multiple implementations separately or in any suitable subcombination. Moreover, although features may be described above and below as acting in certain combinations and even initially claimed as such, one or more features from a claimed combination can in some cases be excised from the combination, and the claimed combination may be directed to a subcombination or variation of a subcombination.

A number of implementations have been described. Nevertheless, it will be understood that various modifications may be made without departing from the spirit and scope of the disclosure. For example, example operations, methods, or processes described herein may include more steps or fewer steps than those described. Further, the steps in such example operations, methods, or processes may be performed in different successions than that described or illustrated in the figures. Accordingly, other implementations are within the scope of the following claims.

The details of one or more implementations of the subject matter described in this disclosure are set forth in the accompanying drawings and the description below. Other features, aspects, and advantages of the subject matter will become apparent from the description, the drawings, and the claims.

BRIEF DESCRIPTION OF THE DRAWINGS

It should be noted that the drawing figures may be in simplified form and might not be too precise scale. In reference to the disclosure herein, for purposes of convenience and clarity only, directional terms such as top, bottom, left, right, up, down, over, above, below, beneath, rear, front, distal, and proximal are used with respect to the accompanying drawings. Such directional terms should not be construed to limit the scope of the embodiment in any manner.

DETAILED DESCRIPTION OF THE EMBODIMENTS

The different aspects of the various embodiments can now be better understood by turning to the following detailed description of the embodiments, which are presented as illustrated examples of the embodiments defined in the claims. It is expressly understood that the embodiments as defined by the claims may be broader than the illustrated embodiments described below.

The term "a" or "an" entity refers to one or more of that entity. As such, the terms "a" (or "an"), "one or more" and "at least one" can be used interchangeably herein. It is also to be noted that the terms "comprising," "including," and "having" can be used interchangeably.

It shall be understood that the term "means," as used herein, shall be given its broadest possible interpretation in accordance with 35 U.S.C., Section 112(f). Accordingly, a claim incorporating the term "means" shall cover all structures, materials, or acts set forth herein, and all of the equivalents thereof. Further, the structures, materials or acts and the equivalents thereof shall include all those described in the summary of the invention, brief description of the drawings, detailed description, abstract, and claims themselves.

Unless defined otherwise, all technical and position terms used herein have the same meaning as commonly understood by one of ordinary skill in the art to which the invention pertains. Although many methods and materials similar, modified, or equivalent to those described herein can be used in the practice of the present invention without undue experimentation, the preferred materials and methods are described herein. In describing and claiming the present invention, the following terminology will be used in accordance with the definitions set out below.

Figure 1:
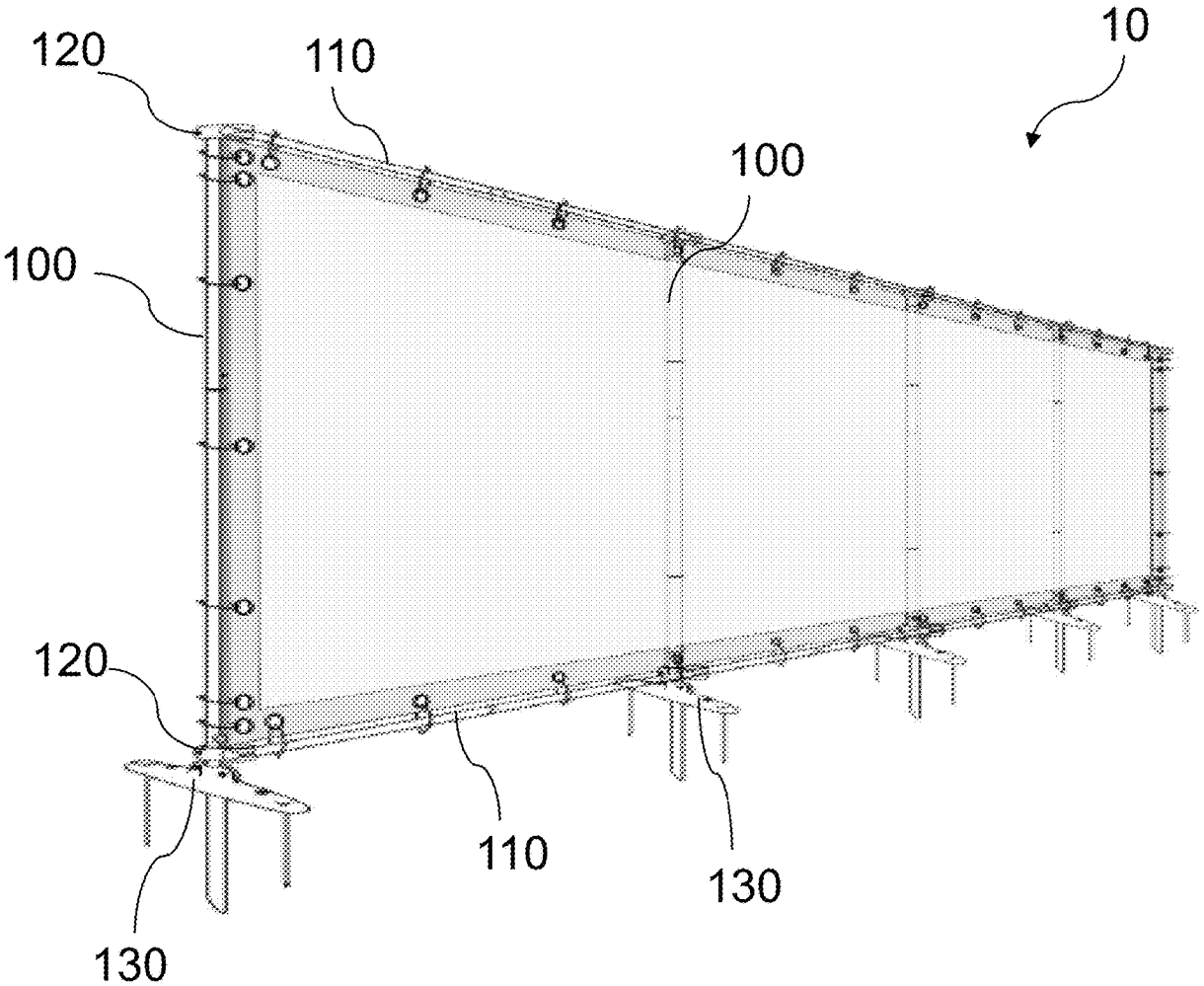
FIG. 1 is a perspective view of a multi-functional fence system according to an aspect of the embodiment.

FIG. 1 generally depicts a multi-functional fence system 10 according to an aspect of the embodiment.

Referring to FIG. 1, the multi-functional fence system 10 may comprise a plurality of vertical supporting frames 100 and a plurality of horizontal supporting frames 110, wherein each vertical supporting frame 100 may be vertically coupled with a pair of horizontal supporting frames 110.

In some embodiments, the multi-functional fence system 10 may further comprise a plurality of connector assemblies 120, wherein each vertical supporting frame 100 may be vertically coupled with a pair of horizontal supporting frames 110 via a plurality of connector assemblies 120. In still some embodiments, the connector assembly 120 may be configured to connect the vertical supporting frame 100 and the horizontal supporting frame 110, wherein the vertical supporting frame 100 may rotate with respect to the horizontal supporting frame 110 via the connector assembly 120.

In still some embodiments, the vertical supporting frame 100 may be vertically arranged to the horizontal supporting frame 110. In still some embodiments, the multi-functional fence system 10 may further comprise an elongated base supporting unit 130 supported below the connector assembly 120.

Figure 2:
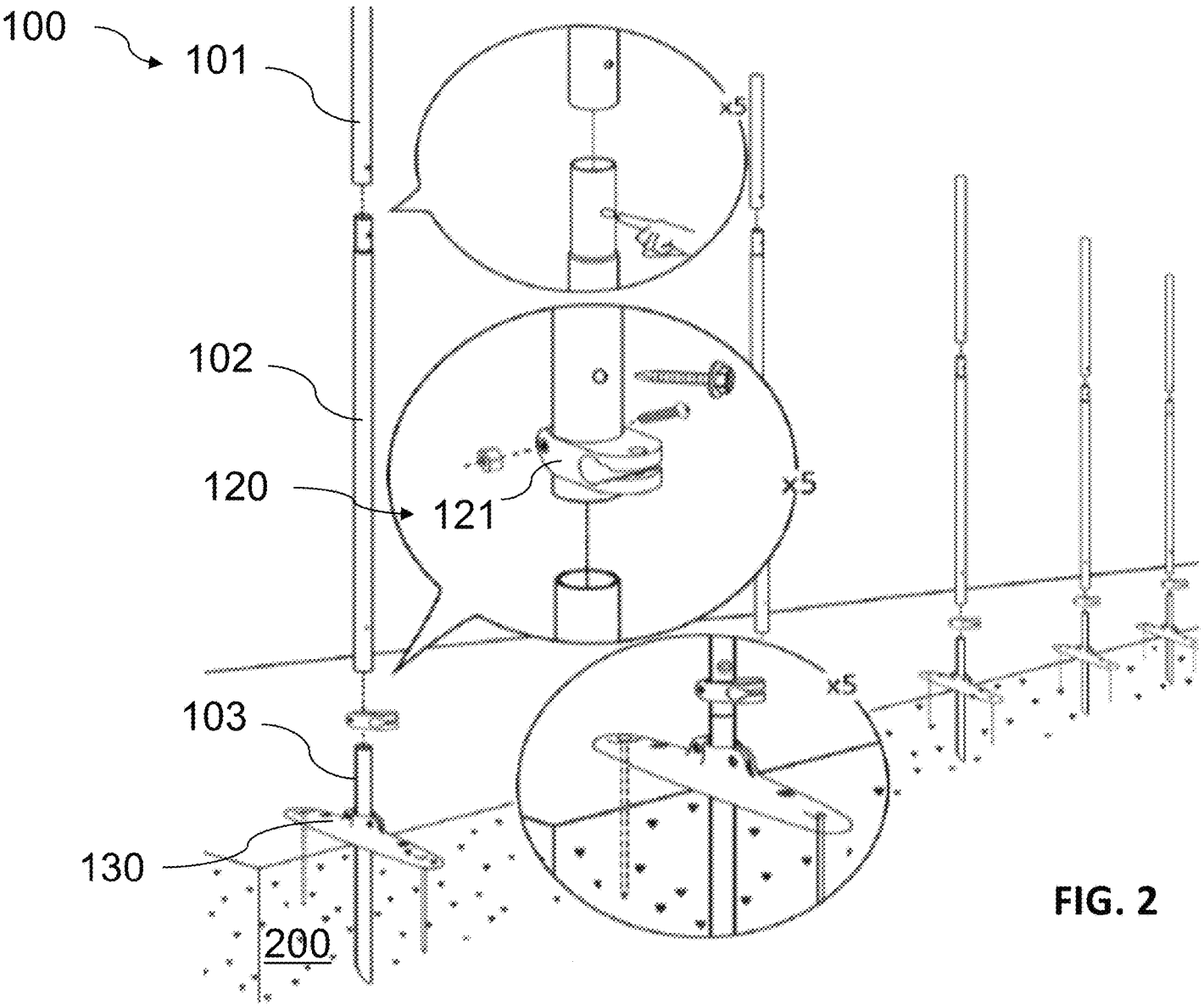
FIG. 2 is an exploded view of the vertical supporting frame according to an aspect of the embodiment.

FIG. 2 generally depicts an exploded view of the vertical supporting frame 100 according to an aspect of the embodiment.

In still some embodiments, the vertical supporting frame 100 may comprise a bottom portion 103 passed through the elongated base supporting unit 130, wherein the bottom portion 103 of the vertical supporting frame 100 may be inserted into a ground 200.

In still some embodiments, the vertical supporting frame 100 may comprise a top portion 101 coupled with a middle portion 102 of the vertical supporting frame 100, and the bottom portion 103 of the vertical supporting frame 100 may be coupled with the middle portion 102 of the vertical supporting frame 100.

In still some embodiments, the bottom portion 103 of the vertical supporting frame 100 may be coupled with the middle portion 102 of the vertical supporting frame 100 with at least one screw, wherein the screw may be positioned above the connector assembly 120.

As shown in the details of FIG. 2, the connector assembly 120 may further comprise a first connector 121, wherein the first connector 121 may be coupled on the middle portion 102 and the bottom portion 103 of the vertical supporting frame 100 via at least one bolt and at least one screw.

Figure 3:
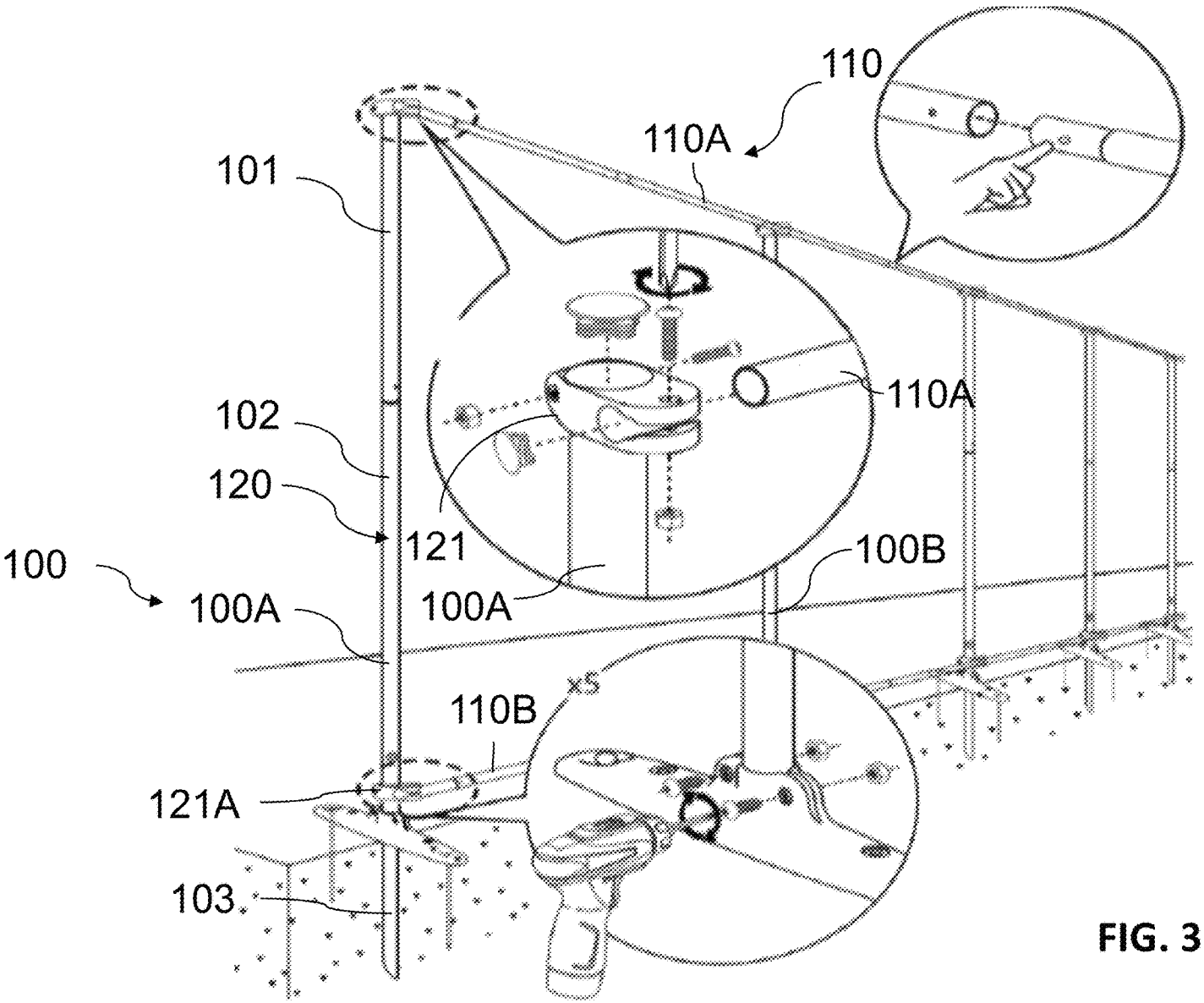
FIG. 3 is a perspective view of the vertical supporting frame, the horizontal supporting frame, and the first connector according to an aspect of the embodiment.

FIG. 3 generally depicts a perspective view of the plurality of vertical supporting frames 100 and the plurality of horizontal supporting frames 110 according to an aspect of the embodiments.

Referring to FIG. 3, in still some embodiments, the vertical supporting frame 100 may comprise a first vertical supporting frame 100A and the horizontal supporting frame 110 may comprise a first horizontal supporting frame 110A and a second horizontal supporting frame 110B. For example, the first connector 121 may be coupled with the first horizontal supporting frame 110A and the first vertical supporting frame 100A. It should be noted that, in some embodiments, the connector assembly 120 may comprise a first pair of first connectors 121, 121A, wherein one of the first pair of the first connectors 121 may be coupled on the top portion 101 of the vertical supporting frame 100 and the other one of the first pair of the first connector 121A may be coupled on the bottom portion 103 and/or middle portion 102 of the vertical supporting frame 100, wherein the first pair of the first connectors 121, 121A may be coupled with the first vertical supporting frame 100A, and one of the first pair of the first connector 121 may be coupled with the first horizontal supporting frame 110A and the other one of the first pair of the first connector 121A may be coupled with the second horizontal supporting frame 110B. For another example, the vertical supporting frames 100 may further comprise the second vertical supporting frame 100B parallelly arranged with respect to the first vertical supporting frame 100A, and in such a manner, the first horizontal supporting frame 110A may be parallel to the second horizontal supporting frame 110B.

Figure 4:
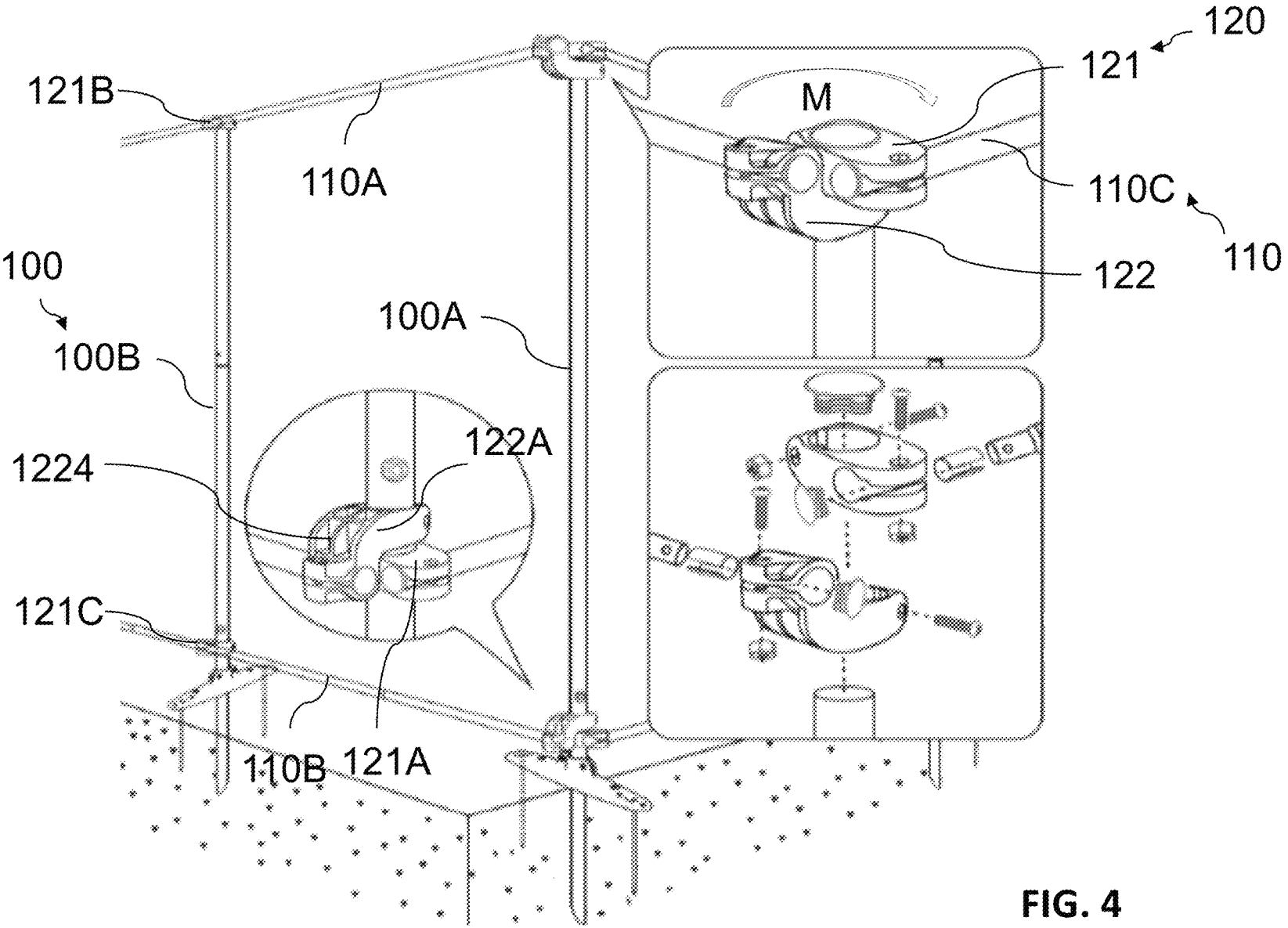
FIG. 4 shows sectional views of the connector assembly according to an aspect of the embodiment.

FIG. 4 generally depicts an exploded view of a first connector 121 and a second connector 122 according to an aspect of the embodiment.

Referring to FIG. 4, the connector assembly 120 may comprise the first connector 121 and a second connector 122, wherein one of the vertically supporting frames (the first vertical supporting frame) 100A may be coupled with the first connector 121 and the second connector 122.

In some embodiments, the connector assembly 120 may comprise the first pair of the first connectors 121, 121A and a first pair of the second connector 122, 122A, and the second pair of the first connectors 121B, 121C, wherein the first pair of the first connectors 121, 121A and the first pair of the second connectors 122, 122A may be coupled with the first vertical supporting frame 100A, and in such a manner, the second pair of the first connectors 121B, 121C may be coupled with the second vertical supporting frame 100B.

In still some embodiments, the first connector 121 may be rotated with respect to the second connector 122 along the same one of the vertical supporting frames (the first vertical supporting frame) 100A from a predetermined range of degree "M", which is from sixty degrees to one hundred degrees.

Continuing to FIG. 4, in some embodiments, the plurality of horizontal supporting frames may further comprise a third horizontal supporting frame 110C, wherein the first connector 121 may be coupled on the third horizontal supporting frame 110C and the second connector 122 may be coupled with the first horizontal supporting frame 110A, and in such a manner, the first connector 121 and the second connector 122 may be pivotally connected through the first vertical supporting frame 100A.

In still some embodiments, the connector assembly 120 may comprise a second pair of first connectors 121B, 121C, wherein the first horizontal supporting frame 110A may be coupled with one of the first pair of the second connector 122 and coupled with one of the second pair of the first connector 121B, and in such a manner, the one of the first pair of the second connector 122 may be coupled with the first vertical supporting frame 100A and the one of the second pair of the first connector 121B may be coupled with the second vertical supporting frame 100B. In such a situation, the other one of the first pair of the second connector 122A may be coupled with the second horizontal supporting frame 110B and the other one of the second pair of the first connector 121C may also be coupled with the second horizontal supporting frame 110B, wherein the other one of the first pair of the first connector 121A may be coupled with the first vertical supporting frame 100A and the other one of the second pair of the first connectors 121C may be coupled with the second vertical supporting frame 100B.

It should be noted that, in some embodiments, the first horizontal supporting frame (one of the horizontal supporting frames) 110A may be angled with the third horizontal supporting frame (the other one of the horizontal supporting frames) 110C from sixty degrees to one hundred degrees, and in such a way, the first connector 121 and the second connector 122 may be coupled with the first vertical supporting frame (one of the horizontal supporting frames) 100A and the first connector 121 may be coupled with the third horizontal supporting frame 110C A and the second connector 122 may be coupled with the first horizontal supporting frame (the other one of the horizontal supporting frames) 110A.

Figure 5:
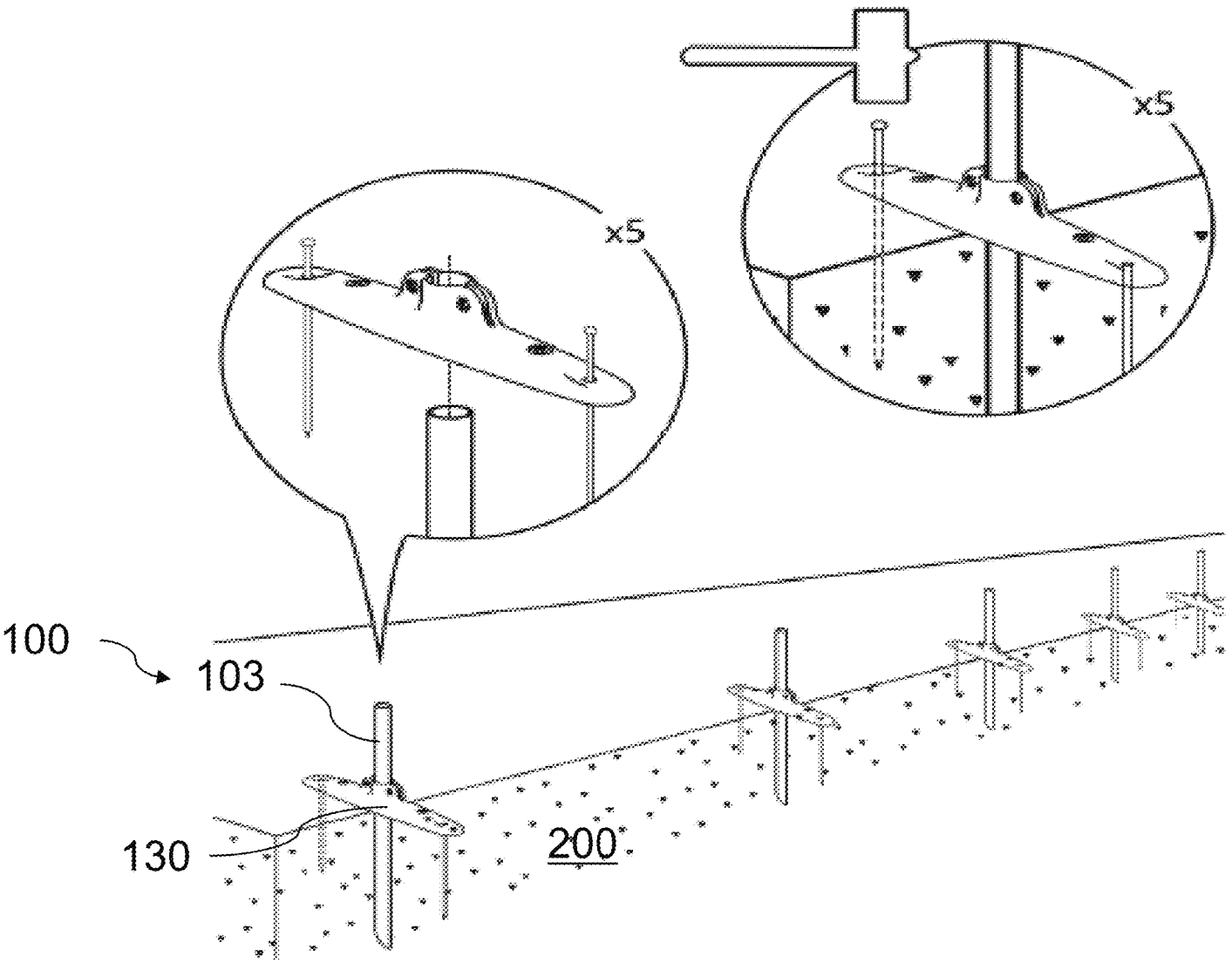
FIG. 5 shows the vertical supporting frame being supported on the elongated base supporting unit according to an aspect of the embodiment.

FIG. 5 generally depicts the elongated base supporting unit 130 according to an aspect of the embodiments.

Referring to FIG. 5, the bottom portion 103 of the vertical supporting frame 100 may be passed through the elongated base supporting unit 130 and further inserted into the ground 200. In some embodiments, the elongated base supporting unit 130 may be affixed on the ground 200 through a plurality of fasteners, wherein the fasteners may be passed through the elongated base supporting unit 130 and further inserted into the ground 200.

Figure 6:
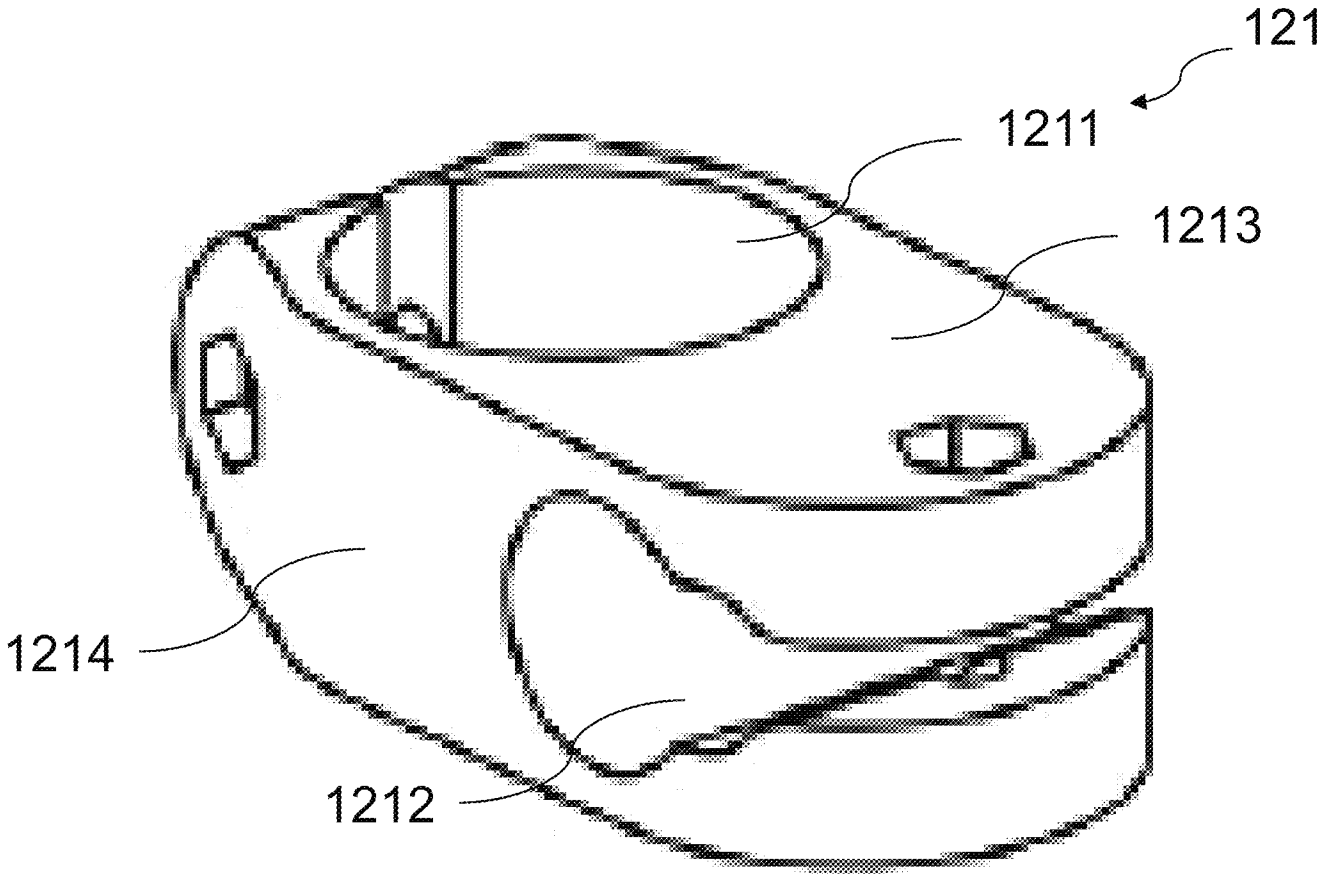
FIG. 6 is a perspective view of the first connector according to an aspect of the embodiment.

FIG. 6 generally depicts a perspective view of the first connector 121 according to an aspect of the embodiment.

Referring to FIG. 6, the first connector 121 may have a first main through hole 1211 vertically passed through the first connector 121, and a first side through hole 1212 horizontally passed through the first connector 121.

Referring back to FIG. 4, the first vertical supporting frame 100A may be passed through the first main through hole 1211 and the third horizontal supporting frame 100C may be passed through the first side through hole 1212.

It should be noted that, in such embodiments, the connector assembly may further comprise a plurality of first fasteners configured to affix the first connector 121 with the vertical supporting frame 100 and the horizontal supporting frame 110, wherein the first fasteners may be adjacent to the first main through hole 1211 and the first side through hole 1212.

Figure 7:
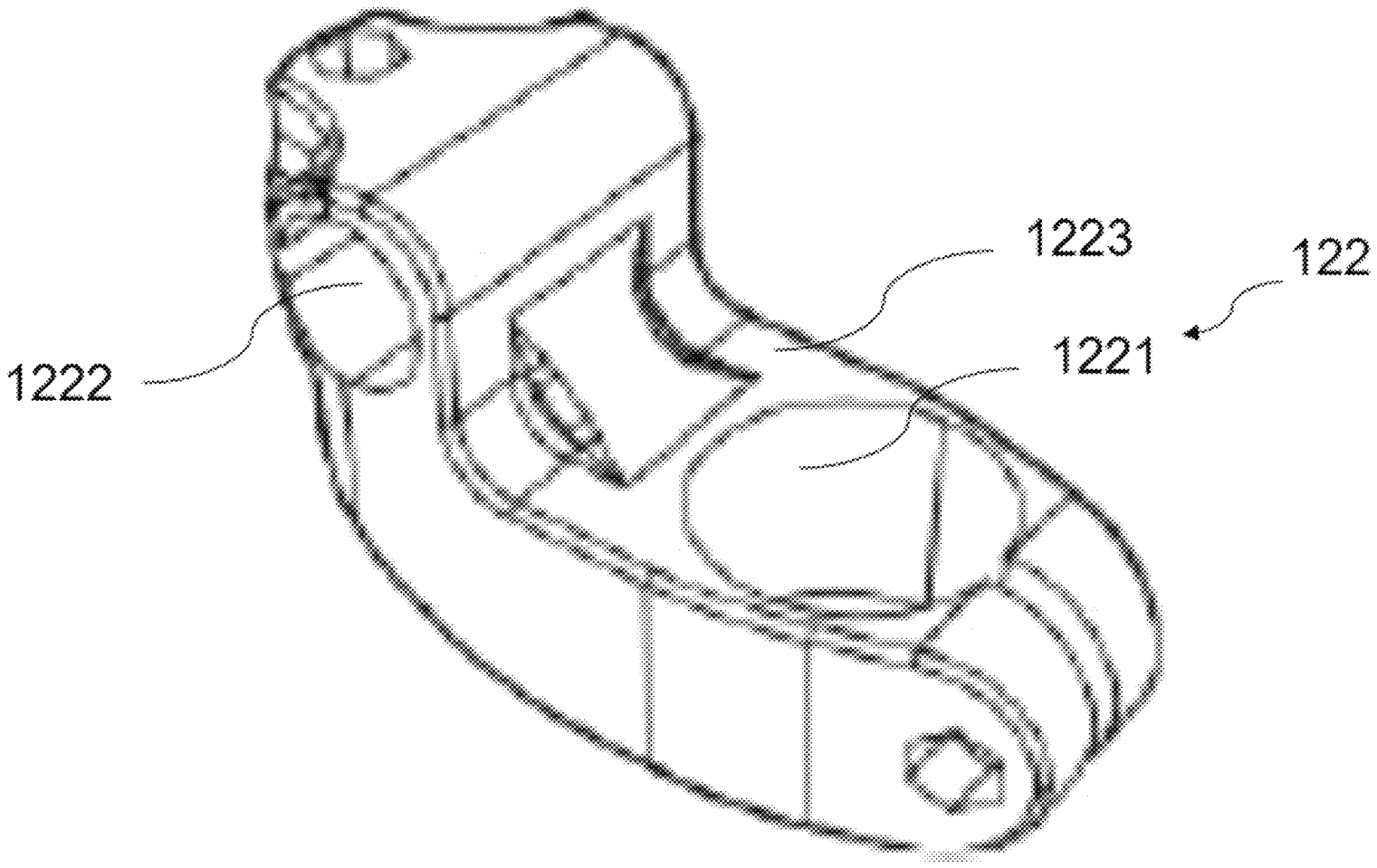
FIG. 7 is a perspective view of the second connector according to an aspect of the embodiment.

FIG. 7 generally depicts a perspective view of the second connector 122 according to an aspect of the embodiment.

Referring to FIG. 7, the second connector 122 may have a second main through hole 1221 vertically passed through the second connector 122, and a second side through hole 1222 horizontally passed through the second connector 122.

In some embodiments, referring back to FIG. 4, the first vertical supporting frame 100A may pass through the second main through hole 1221 of the second connector 122, and the first horizontal supporting frame 110A may pass through the second side through hole 1222 of the second connector 122.

With specific reference to FIG. 4, the first horizontal supporting frame (the one of the horizontal supporting frames) 110A may be secured at the same height as the third horizontal supporting frame (the other one of the horizontal supporting frames) 110C along the first vertical supporting frame 100A, and in such a way, the first horizontal supporting frame 110A may be pivotally rotated with respect to the third horizontal supporting frame 110C through the first vertical supporting frame 100A.

Turning now to FIGS. 6 and 7, the first connector 121 may have a top face 1213 and a side face 1214 integrally extended from the top face 1213 and a second connector 122 may have a concave inner face 1223 and a convex outer face 1224 (see FIG. 4).

In some embodiments, referring back to FIG. 4, while the first connector 121 and the second connector 122 are affixed on the first vertical supporting frame 100A, and at the same time, the first connector 121 is affixed to the third horizontal supporting frame 110C and the second connector 122 is affixed to the first horizontal supporting frame 110A, wherein the concave inner face 1223 of the second connector 122 may be faced towards the top face 1213 and the side face 1214 of the first connector 121, and the convex outer face 1224 of the second connector 122 may be formed on an opposite side of the concave inner face 1223 of the second connector 122.

In still some embodiments, the second connector 122 may be overlappedly arranged with the first connector 121.

Figure 8:
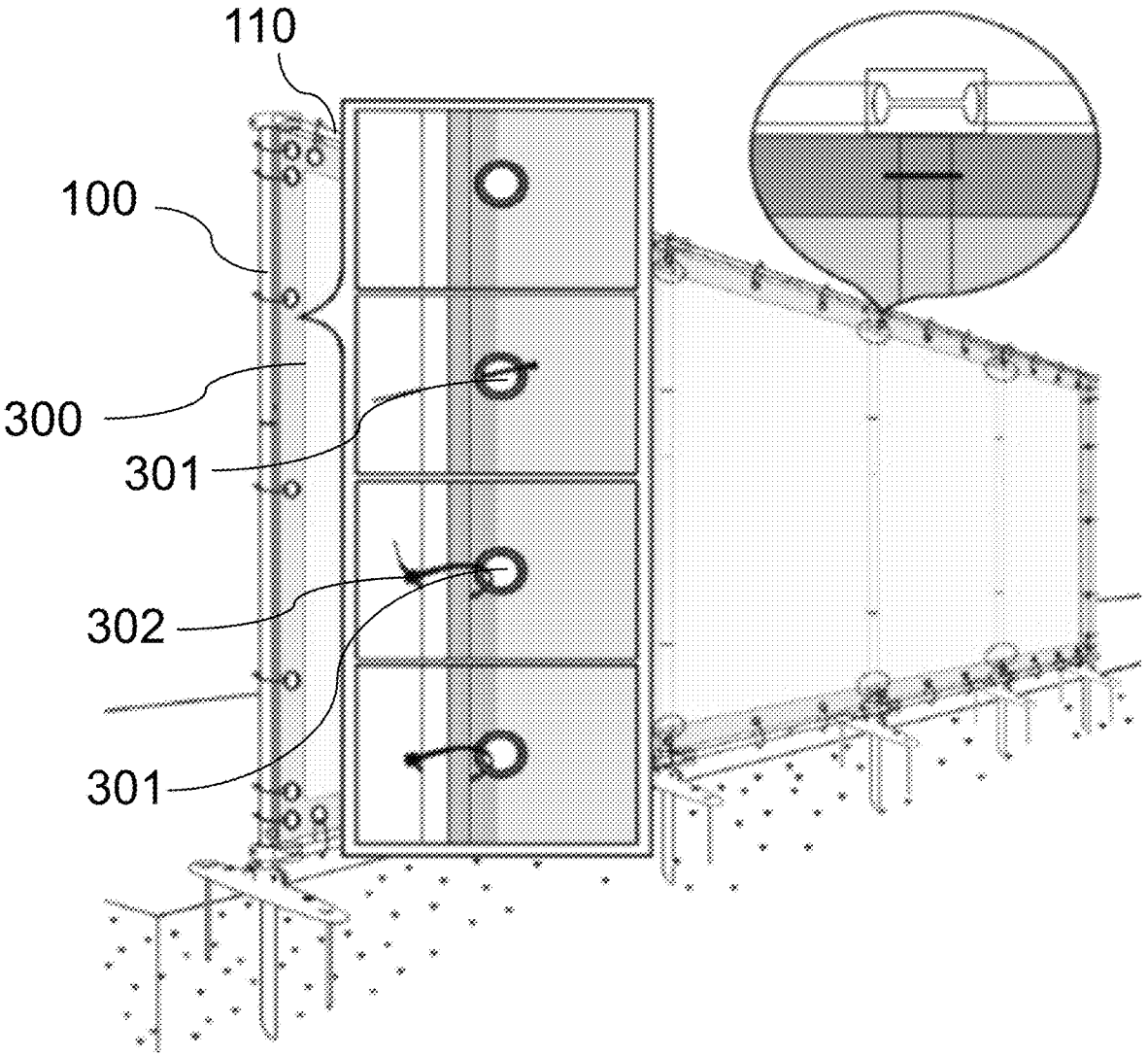
FIG. 8 is a sectional view of a cover of the multi-functional fence system according to an aspect of the embodiment.

FIG. 8 generally depicts a cover 300 of the multi-functional fence system according to an aspect of the embodiments.

Referring to FIG. 8, the multi-functional fence system may further comprise a cover 300 having a plurality locking through holes 301, wherein the plurality of locking through holes 301 may be spacedly arranged along a periphery of the cover 300.

In some embodiments, the multi-functional fence system may further comprise a plurality of cable 302 configured to secure the cover 300 on the vertical supporting frames 100 and the horizontal supporting frames 110.

A "periphery," as used herein, refers to the external boundary of the cover of the invention. The periphery can include a fold or hem formed at the periphery.

Figure 9:
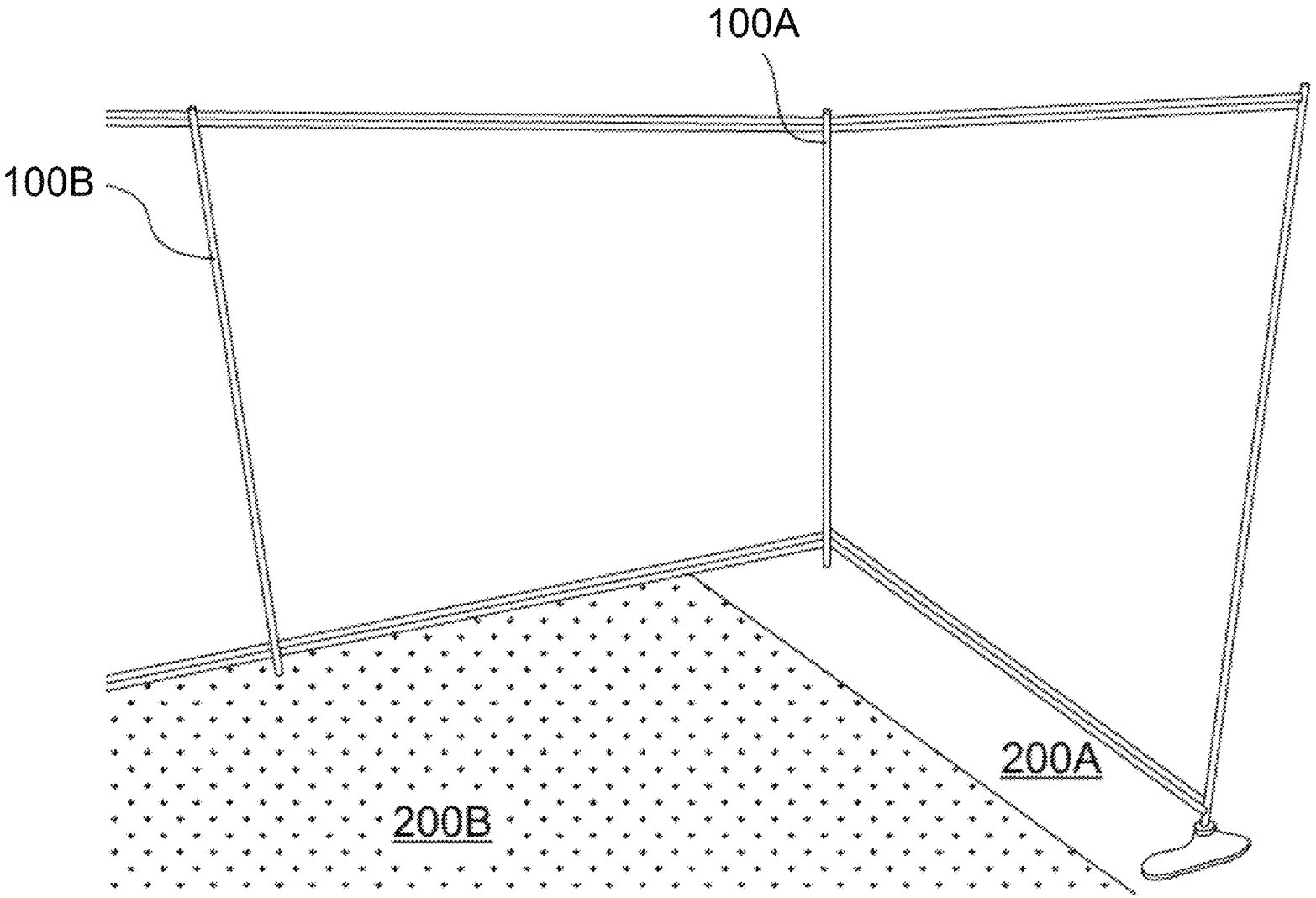
FIG. 9 shows the multi-functional fence system installed on two different kinds and levels of grounds according to an aspect of the embodiment.

FIG. 9 generally depicts the multi-functional fence system installed on different kinds and different levels of the ground according to an aspect of the embodiment.

Referring to FIG. 9, the first vertical supporting frame 100A may be installed on a concrete ground 200A, and the second vertical supporting frame 100B may be installed on a grass ground 200B, wherein the concrete ground 200A and the grass ground 200B are at the different levels, and in such a manner, the connector assemblies 120 may be coupled on different levels of locations of the first vertical supporting frame 100A and the second vertical supporting frame 100B to securely affix the multi-functional fence system on the two different levels of grounds.

Many alterations and modifications may be made by those having ordinary skill in the art without departing from the spirit and scope of the disclosed embodiments. Therefore, it must be understood that the illustrated embodiments have been set forth only for the purposes of example and that it should not be taken as limiting the embodiments as defined by the following claims. For example, notwithstanding the fact that the elements of a claim are set forth below in a certain combination, it must be expressly understood that the embodiment includes other combinations of fewer, more, or different elements, which are disclosed herein even when not initially claimed in such combinations.

Thus, specific embodiments and applications of the multi-functional fence system have been disclosed. It should be apparent, however, to those skilled in the art that many more modifications besides those already described are possible without departing from the disclosed concepts herein. The disclosed embodiments, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Insubstantial changes from the claimed subject matter as viewed by a person with ordinary skill in the art, now known or later devised, are expressly contemplated as being equivalent within the scope of the claims. Therefore, obvious substitutions now or later known to one with ordinary skill in the art are defined to be within the scope of the defined elements. The claims are thus to be understood to include what is specifically illustrated and described above, what is conceptually equivalent, what can be substituted and also what essentially incorporates the essential idea of the embodiments. In addition, where the specification and claims refer to at least one of something selected from the group consisting of A, B, C . . . and N, the text should be interpreted as requiring at least one element from the group which includes N, not A plus N, or B plus N, etc.

The words used in this specification to describe the various embodiments are to be understood not only in the sense of their commonly defined meanings but to include by special definition in this specification structure, material or acts beyond the scope of the commonly defined meanings. Thus, if an element can be understood in the context of this specification as including more than one meaning, then its use in a claim must be understood as being generic to all possible meanings supported by the specification and by the word itself.

The definitions of the words or elements of the following claims therefore include not only the combination of elements which are literally set forth but all equivalent structure, material or acts for performing substantially the same function in substantially the same way to obtain substantially the same result. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a subcombination.

What is claimed is:

1. A multi-functional fence system comprising:

a plurality of vertical supporting frames;

a plurality of horizontal supporting frames;

a plurality of connector assemblies configured to connect the vertical supporting frames and the horizontal supporting frames; and a plurality of first fasteners configured to affix one of the plurality of the connector assemblies one of the plurality of vertical supporting frames and one of the plurality of the horizontal supporting frames; wherein the one of the plurality of the vertical supporting frames is rotated with respect to the one of the plurality of the horizontal supporting frames via the one of the plurality of the connector assembies; wherein one of the plurality of the connector assemblies comprises a first connector having a top face and a side face integrally extended from the top face and a second connector, wherein the second connector comprises a concave inner face, a convex outer face formed on an opposite side of the concave inner face, a first side surface, and a second side surface; wherein the first side surface and the second side surface are separately located on an opposite side of the concave inner face and the convex outer face; wherein the second connector comprises a second main through hole passed through the concave inner face and the convex outer face and a second side through hole passed through the first side surface and the second side surface; wherein each of the first connector and the second connector comprises a first section and a second section spacedly formed with the first section; wherein each of the plurality of the first fasteners is passed through the first section and the second section of the first connector or the first section and the second section of the second connector without passing through the one of the plurality of the vertical supporting frames and the one of the plurality of the horizontal supporting frames.

2. The multi-functional fence system of claim 1, wherein one of the plurality of the vertical supporting frames is vertically arranged to one of the plurality of the horizontal supporting frames.

3. The multi-functional fence system of claim 1, further comprising an elongated base supporting unit, wherein a bottom portion of one of the plurality of the vertical supporting frames is passed through the elongated base supporting unit and inserted into a ground.

4. The multi-functional fence system of claim 1, wherein one of the plurality of the vertical supporting frames comprises a top portion coupled with a middle portion of one of the plurality of the vertical supporting frames, and a bottom portion of one of the plurality of the vertical supporting frames is coupled with the middle portion of one of the plurality of the vertical supporting frames.

5. The multi-functional fence system of claim 1, wherein one of the plurality of the vertical supporting frames is coupled with the first connector and the second connector.

6. The multi-functional fence system of claim 5, wherein the first connector is rotated with respect to the second connector along the same one of the plurality of the vertical supporting frames from sixty degrees to one hundred degrees.

7. The multi-functional fence system of claim 5, wherein the second main through hole is vertically passed through the second connector, and the second side through hole is horizontally passed through the second connector.

8. The multi-functional fence system of claim 1, wherein the connector assemblies comprise a first pair of first connectors and a first pair of second connectors, wherein the first pair of the first connectors and the first pair of the second connectors are coupled with one of the plurality of the vertical supporting frames.

9. The multi-functional fence system of claim 8, wherein the connector assemblies comprise a second pair of first connectors, wherein the second pair of the first connectors are coupled to another one of the plurality of the vertical supporting frames.

10. The multi-functional fence system of claim 1, wherein the first connector is coupled with one of the plurality of the horizontal supporting frames and the second connector is coupled with another one of the plurality of the horizontal supporting frames, wherein one of the plurality of the horizontal supporting frames is angled with respect to another one of the plurality of the horizontal supporting frames from sixty degrees to one hundred degrees.

11. The multi-functional fence system of claim 1, wherein the first connector has a first main through hole vertically passed through the first connector, and a first side through hole horizontally passed through the first connector.

12. The multi-functional fence system of claim 11, wherein one of the plurality of vertical supporting frames is passed through the first main through hole and one of the plurality of the horizontal supporting frames is passed through the first side through hole.

13. The multi-functional fence system of claim 1, wherein one of the plurality of the vertical supporting frames is passed through the second main through hole and one of the plurality of the horizontal supporting frame is passed the second side through hole.

14. The multi-functional fence system of claim 1, the first connector has a first main through hole, wherein one of the plurality of the vertical supporting frames is passed through the first main through hole and the second main through hole.

15. The multi-functional fence system of claim 1, wherein the first connector has a first side through hole, wherein one of the plurality of the horizontal supporting frames is passed through the first side through hole and another one of the plurality of the horizontal supporting frames is passed through the second side through hole.

16. The multi-functional fence system of claim 15, wherein one of the plurality of the horizontal supporting frames is secured at the same height as another one of the plurality of the horizontal supporting frames on one of the plurality of the vertical supporting frames.

17. The multi-functional fence system of claim 1, wherein the concave inner face of the second connector is faced towards the top face and the side face of the first connector.

18. The multi-functional fence system of claim 1, wherein the first connector is overlappedly arranged with the second connector.

19. The multi-functional fence system of claim 1, further comprises a cover having a plurality locking through holes cooperated with a plurality of cable to secure the cover on the vertical supporting frames and the horizontal supporting frames.

* * * * *